US006364466B1

(12) United States Patent
Chen et al.

(10) Patent No.: US 6,364,466 B1
(45) Date of Patent: Apr. 2, 2002

(54) PARTICLE TOLERANT INK-FEED CHANNEL STRUCTURE FOR FULLY INTEGRATED INKJET PRINTHEAD

(75) Inventors: Chien-Hua Chen; Kenneth M. Kramer, both of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/727,429

(22) Filed: Nov. 30, 2000

(51) Int. Cl.[7] ..... B41J 2/05; B41J 2/175

(52) U.S. Cl. ..... 347/65; 347/93

(58) Field of Search ..... 347/63, 65, 67, 347/93, 56, 92

(56) References Cited

U.S. PATENT DOCUMENTS

| | | | | | |
|---|---|---|---|---|---|
| 4,789,425 | A | | 12/1988 | Drake et al. | 216/27 |
| 4,864,329 | A | | 9/1989 | Kneezel et al. | 347/93 |
| 5,148,185 | A | * | 9/1992 | Abe et al. | 347/65 |
| 5,387,314 | A | * | 2/1995 | Baughman et al. | 347/63 |
| 6,003,977 | A | * | 12/1999 | Weber et al. | 347/63 |

FOREIGN PATENT DOCUMENTS

| | | | | |
|---|---|---|---|---|
| EP | 0244214 A1 | | 4/1987 | B41J/3/04 |
| EP | 0244214 A1 | * | 4/1987 | B41J/3/04 |

* cited by examiner

*Primary Examiner*—John Barlow
*Assistant Examiner*—Juanita Stephens

(57) ABSTRACT

Described herein is a monolithic printhead formed using integrated circuit techniques. Thin film layers, including a resistive layer, are formed on a top surface of a silicon substrate. The various layers are etched to provide heater resistors and conductors. The thin film layers are also etched to expose portions of the upper surface of the substrate where ink feed holes leading into ink chambers are to be formed. A trench is etched in the bottom surface of the substrate while leaving a relatively thin membrane of the substrate underlying the thin film layers. After the trench is formed and using a backside etch, ink feed holes are formed in the substrate membrane leading from the trench to the ink chambers. Ink channels are also formed in the substrate membrane leading to sides of the ink feed holes. These channels preferably have widths smaller than the widths of the ink feed holes. Ink particles or other particles which may clog an ink feed hole opening do not block the narrower channels leading to the sides of the ink feed holes. Various examples of such channels and ink feed holes are described to form a particle-tolerant printhead for use in an inkjet printer.

21 Claims, 4 Drawing Sheets

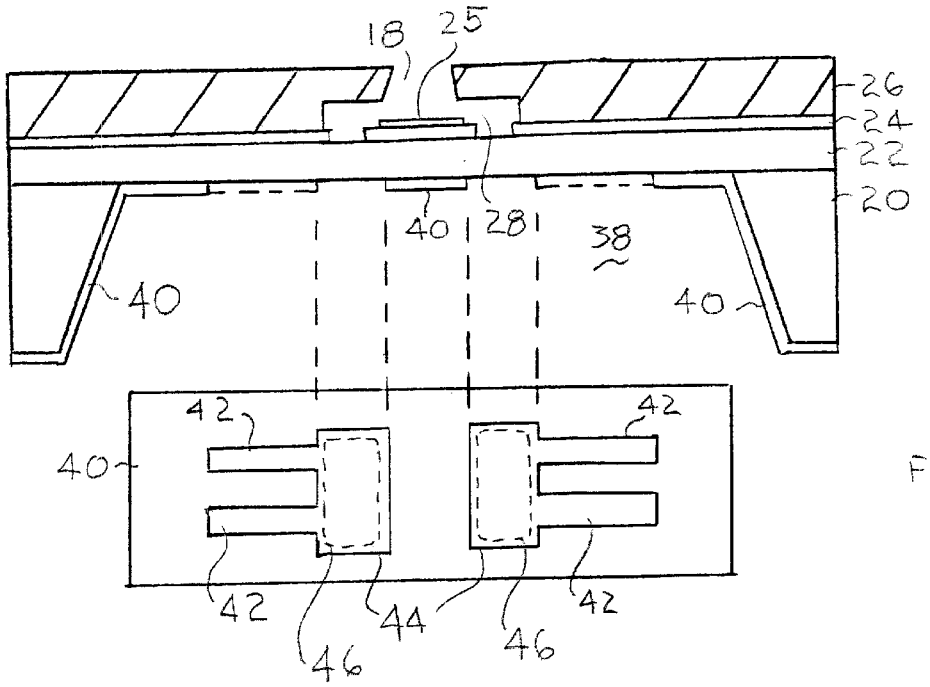
FIG. 5A
FIG. 5B
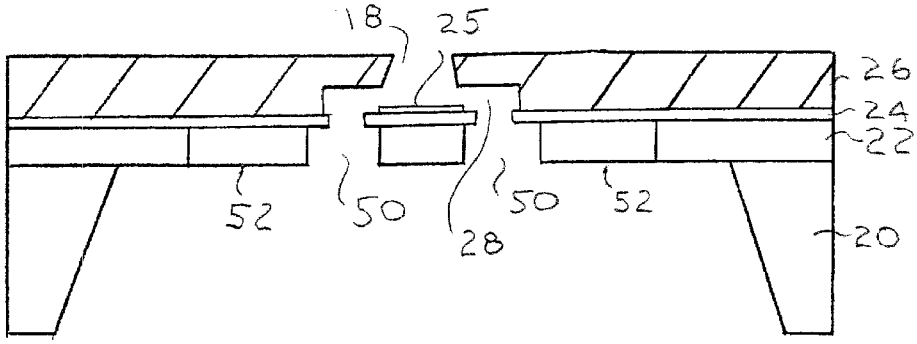
FIG. 6
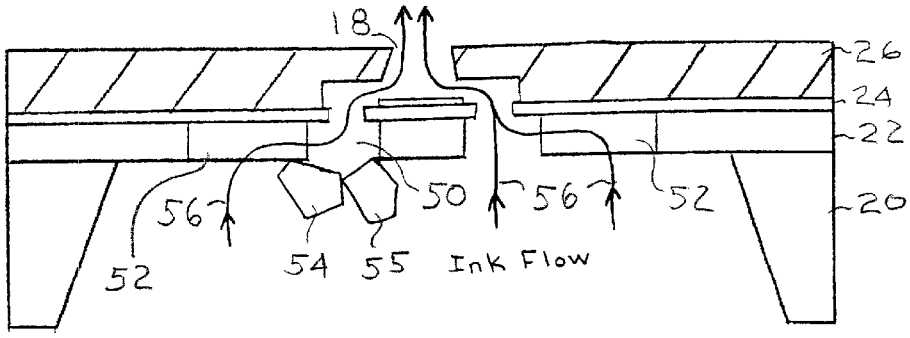
FIG. 7

PARTICLE TOLERANT INK-FEED CHANNEL STRUCTURE FOR FULLY INTEGRATED INKJET PRINTHEAD

CROSS-REFERENCE TO RELATED APPLICATIONS

This application is related to the following U.S. applications: Ser. No. 09/384,817, filed Aug. 27, 1999, entitled "Fully Integrated Thermal Inkjet Printhead Having Thin Film Layer Shelf," by Naoto Kawamura et al.; Ser. No. 09/384,814, filed Aug. 27, 1999, entitled "Fully Integrated Thermal Inkjet Printhead Having Etched Back PSG Layer," by Naoto Kawamura et al.; and Ser. No. 09/384,849, filed Aug. 27, 1999, entitled "Fully Integrated Thermal Inkjet Printhead Having Multiple Ink Feed Holes Per Nozzle," by Naoto Kawamura et al. The above applications are assigned to the present assignee and incorporated herein by reference.

FIELD OF THE INVENTION

This invention relates to inkjet printers and, more particularly, to a monolithic printhead for an inkjet printer.

BACKGROUND

Inkjet printers typically have a printhead mounted on a carriage that scans back and forth across the width of a sheet of paper feeding through the printer. Ink from an ink reservoir, either on-board the carriage or external to the carriage, is fed to ink ejection chambers on the printhead. Each ink ejection chamber contains an ink ejection element, such as a heater resistor or a piezoelectric element, which is independently addressable. Energizing an ink ejection element causes a droplet of ink to be ejected through a nozzle for creating a small dot on a medium. The pattern of dots created forms an image or text.

Additional information regarding a particular printhead and inkjet printer is found in U.S. Pat. No. 5,648,806, entitled "Stable Substrate Structure for a Wide Swath Nozzle Array in a High Resolution Inkjet Printer," by Steven Steinfield et al., assigned to the present assignee and incorporated herein by reference.

As the resolutions and printing speeds of printheads increase to meet the demanding needs of the consumer market, new printhead manufacturing techniques and structures are required. One approach for improving the performance, ease of manufacturing, and reliability of printheads is to form the entire printhead as a monolithic structure, generally using integrated circuit fabrication techniques.

As the resolutions of the printheads increase and the size of each ink ejection chamber and nozzle grows smaller, clogging of a chamber or nozzle with an ink particle or other contaminant becomes more likely. The clogging of a chamber or nozzle degrades the quality of the image being printed. Hence, there is a need for techniques to lower the likelihood of a particle clogging a chamber or nozzle.

SUMMARY

Described herein is a monolithic printhead formed using integrated circuit techniques. Thin film layers, including a resistive layer, are formed on a top surface of a silicon substrate. The various layers are etched to provide conductive leads to heater resistor elements. Additional layers may perform other functions such as passivation, heat sinking, and electrical isolation. Piezoelectric elements may be used instead of the resistive elements.

An orifice layer is formed on the top surface of the thin film layers to define the nozzles and ink ejection chambers. In one embodiment, a photodefinable material is used to form the orifice layer.

A trench is etched in the bottom surface of the substrate, where the etch leaves a thin silicon membrane under the ink ejection chambers.

Ink feed holes are formed through the silicon membrane, using a backside etch, so that ink may flow from an ink reservoir, into the trench, through the ink feed holes, and into associated ink ejection chambers. To reduce the likelihood of an ink particle blocking ink from entering an ink chamber, narrow ink channels are etched in the bottom surface of the thin silicon membrane leading to each of the holes such that, if an ink particle blocks an ink feed hole opening, ink can still enter the chamber by flowing within the relatively narrow channels leading into a side of the ink feed hole. Any number of channels per ink feed hole can be used.

The resulting fully integrated thermal inkjet printhead can be manufactured to a very precise tolerance since the entire structure is monolithic, meeting the needs for the next generation of printheads.

BRIEF DESCRIPTION OF THE DRAWINGS

FIGS. 2, 3, 4, 5A, and 6 are cross-sectional views across a portion of the printhead along line 2—2 in FIG. 1 at various steps during the fabrication of the printhead.

FIG. 5B is a plan view of a portion of the printhead in FIG. 5B, showing the channel and hole pattern in layer 22.

FIG. 7 is a cross-sectional view of the printhead of FIG. 6, after the printhead of FIG. 6 has been mounted in a printer, illustrating ink particles blocking an ink feed hole opening but allowing ink to flow through narrow channels formed in the silicon membrane and into the ink ejection chamber.

DETAILED DESCRIPTION OF THE EMBODIMENTS

Figure 1:
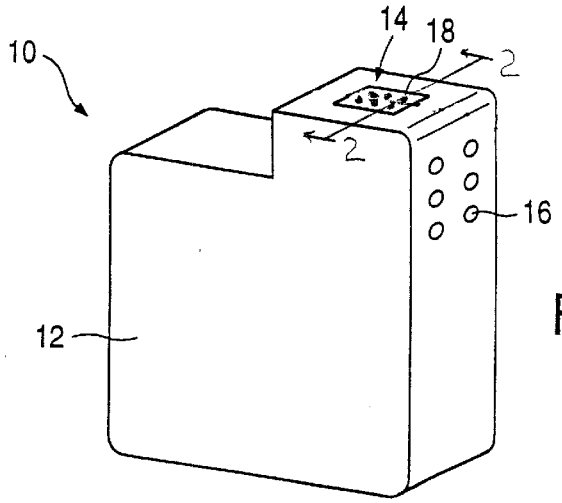
FIG. 1 is a perspective view of an embodiment of a print cartridge housing a monolithic printhead of the present invention.

FIG. 1 is a perspective view of one type of inkjet print cartridge 10 which may incorporate the printhead structures of the present invention. The print cartridge 10 is the type that contains a substantial quantity of ink within its body 12, but another suitable print cartridge may be the type that receives ink from an external ink supply either mounted on a scanning carriage or connected to the printhead via a flexible tube.

The ink is supplied to a printhead 14. Printhead 14, to be described in detail later, channels the ink into ink ejection chambers, each chamber containing an ink ejection element. Electrical signals are provided to contacts 16 to individually energize the ink ejection elements to eject a droplet of ink through an associated nozzle 18. The structure and operation of conventional print cartridges are very well known.

Figure 2:
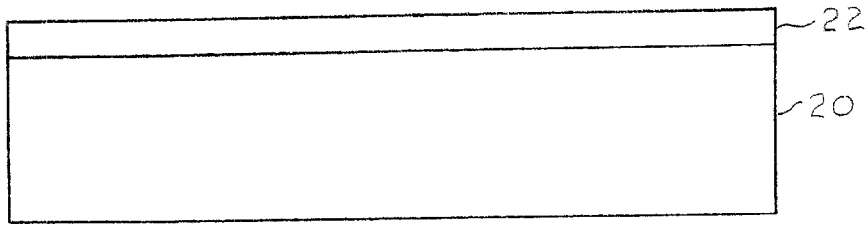

FIG. 2 is a cross-sectional view of the printhead of FIG. 1 taken along line 2—2 in FIG. 1. Although a printhead may have 300 or more nozzles and associated ink ejection chambers, detail of only a single ink ejection chamber need be described in order to understand the invention. It should also be understood by those skilled in the art that many printheads are formed on a single silicon wafer and separated from one another using conventional techniques.

In FIG. 2, a silicon substrate 20 has an upper surface doped with boron, referred to as a boron doped layer 22. As will be described later, the boron doped layer is an etch stop for a subsequent etch of the silicon substrate 20. The thickness of the boron doped layer 22 can be anywhere from 5 $\mu$m to 50 $\mu$m, depending upon the requirements of the printhead. Such requirements include structural reliability as well as the sinking of heat from the heater resistors. Doping a silicon layer with boron to be used as an etch stop is well known in the field of semiconductor fabrication.

Figure 3:
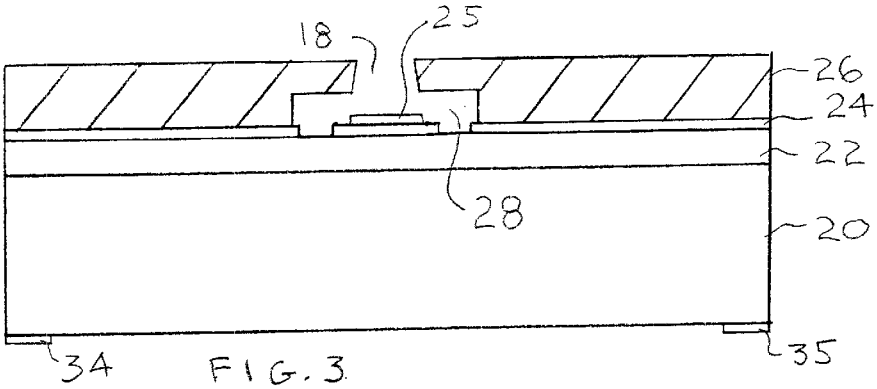

In FIG. 3, various thin film layers 24, including a resistive layer, are formed over layer 22 and etched. Such thin film layers are well known and may be conventional. The various patterned thin film layers perform functions such as providing electrical insulation from the boron doped layer 22, providing the heater resistors 25, providing a thermally conductive path from the heater resistors 25 to the layer 22, providing electrical conductors to the heater resistors 25, and providing passivation for protection from ink. Detail of one embodiment of such thin film layers may be found in U.S. application Ser. No. 09/384,817, or any of the other related applications, previously incorporated by reference.

The thin film layers 24 are etched to expose areas of the boron doped layer 22 where ink feed holes will be formed.

An orifice layer 26 is then deposited and formed. The orifice layer 26 may be formed of a spun-on epoxy (e.g., SU 8) or polyimide material. In other embodiments, the orifice layer 26 may be laminated or screened on. The orifice layer 26 in one embodiment is about 20 $\mu$m thick. The ink ejection chambers 28 and nozzles 18 may be formed by photolithography using an ink ejection chamber mask and a separate nozzle mask. Using the nozzle mask, the photodefinable orifice layer 26 is exposed using a reduced dosage of UV light so as to effectively harden the upper layer of the SU8 layer except in the locations of the nozzles to be formed. The orifice layer 26 then is exposed using the ink ejection chamber mask at full UV dosage to harden the full thickness of the orifice layer 26 in areas surrounding the ink ejection chambers. The resulting exposed orifice layer 26 is then developed to remove the nozzle and ink ejection chamber portions which have not been hardened by exposure to the UV light. Alternatively, techniques may be used to laser ablate the orifice layer 26 to form the nozzles 18 and ink ejection chambers 28. Alternatively, orifice layer 26 may be formed using two layers of photoresist separately etched to form the ink ejection chambers 28 and nozzles 18.

A backside hard mask is then created by forming a layer of silicon dioxide on the backside surface of the wafer, then selectively etching the layer using conventional photolithographic techniques, leaving silicon dioxide portions 34 and 35.

Figure 4:
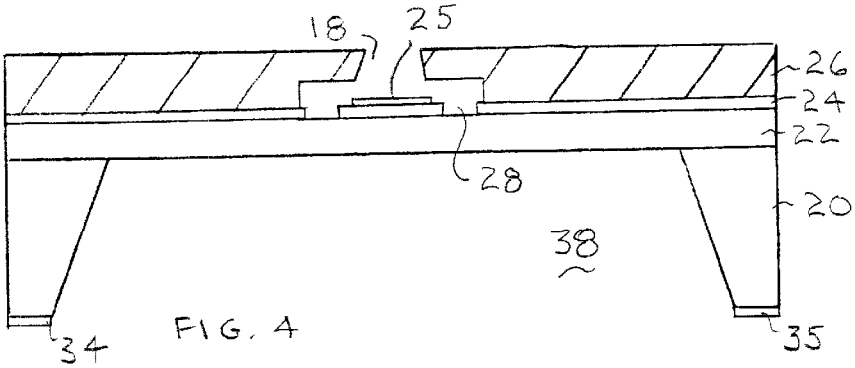
Figure 8:
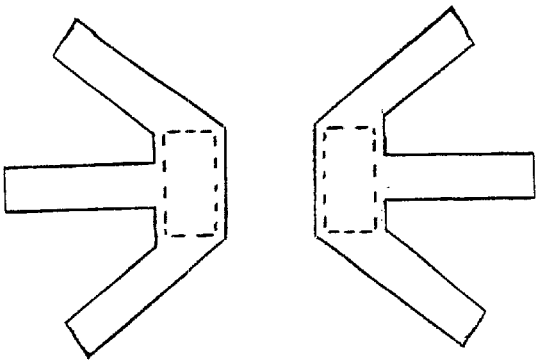
FIGS. 8–12 illustrate examples of alternative channel patterns formed in the silicon membrane.
Figure 9:
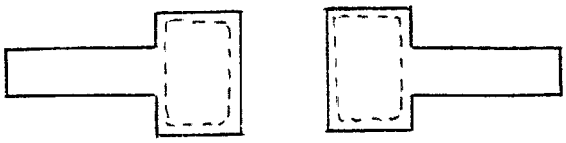
Figure 10:
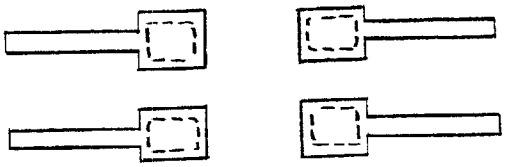
Figure 11:
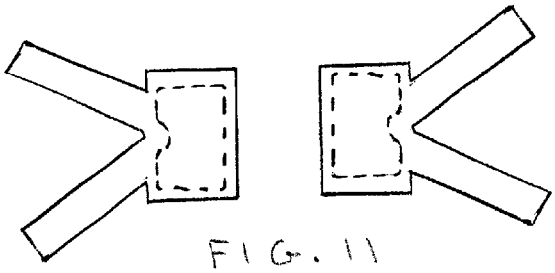
Figure 12:
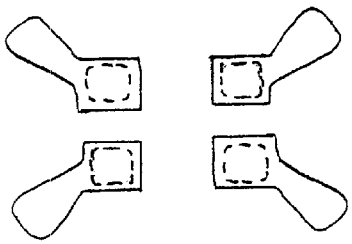

In FIG. 4, a trench 38 is formed, running along the backside of substrate 20, having a length at least as long as the pattern of nozzles 18 on the front surface of the printhead. In one embodiment, trench 38 is etched using a wet-etching process using tetramethyl ammonium hydroxide (TMAH) as an etchant to form the angled profile. Other wet anisotropic etchants may also be used. (See U. Schnakenberg et al., TMAHW Etchants for Silicon Micromachining, Tech. Digest, 6 Int. Conf. Solid State Sensors and Actuators (Transducers '91), San Francisco, Calif., Jun. 24–28, 1991, pp. 815–818.) The trench 38 may extend the length of the printhead or, to improve the mechanical strength of the printhead, only extend a portion of a length of the printhead beneath the ink ejection chambers 28. The boron doped layer 22 acts as an etch stop and will remain after the TMAH etch process.

In FIG. 5A, the trench 38 is coated with a photoresist 40 and selectively exposed to UV light. The photoresist 40 is then developed to pattern the ink feed channels and ink feed hole leading to the ink ejection chamber 28.

FIG. 5B is a view of a portion of the underside of the structure of FIG. 5A showing the formed photoresist pattern for the ink feed channels and ink feed hole. The photoresist pattern consists of a pattern 42 for one or more ink feed channels leading to a pattern 44 for forming ink feed holes through layer 22. The sizes of the openings in thin film layers 24 are shown with dashed outline 46 in FIG. 5B.

In FIG. 6, an anisotropic silicon etch is used to etch from the bottom of the boron doped layer 22 to the thin film layers 24. This is a dry etch process. The etch is selective to oxide; therefore, the bottom layer of the thin film layers 24 should be a field oxide layer to act as an etch stop. The etch forms ink feed holes 50 and ink channels 52 leading to ink ejection chamber 28. The ink channels 52 lead into the sides of the ink feed holes 50. In one embodiment, the ink feed holes previously formed in the thin film layers 24 are smaller than the ink feed holes formed in layer 22 so as to provide a relaxed tolerance for the photoresist 40 patterning step as well as a performance benefit. This leaves shelf portions of the thin film layers 24 over portions of the ink feed holes 50.

The printheads formed on the silicon wafer are then separated, and the printheads are then mounted in a print cartridge (FIG. 1) or otherwise incorporated into an inkjet printer.

FIG. 7 illustrates how the ink channels 52 formed in the boron doped layer 22 result in a particle-tolerant printhead. In FIG. 7, solid ink particles 54 and 55 are blocking an opening of an ink feed hole 50. However, ink is allowed to flow into the ink channels 52 and enters the side of the ink feed hole 50 so as to provide an adequate flow of ink to the ink chamber 28.

In an alternate embodiment, instead of depositing and patterning photoresist 40 in FIGS. 5A and 5B, the layer 22 may be selectively doped with boron in accordance with the ink channel and ink feed hole pattern shown in FIG. 5B. A dielectric film is used as the boron doping mask, and the undoped area will be etched away during the TMAH etch to form the ink feed holes 50 and ink channels 52 in layer 22.

By etching the ink feed holes 50 and ink channels 52 from the backside, the size and shape of the ink channels and holes can be optimized. For example, the ink feed holes formed in layer 22 may be made slightly larger than the ink feed holes in the thin film layer 24 to improve the fluid performance. Also, using a backside etch, versus using a frontside etch to etch holes in layer 22 prior to formation of the orifice layer 26, avoids various drawbacks with the frontside etch. Such drawbacks with a frontside etch include residue from etching the orifice layer 26 being deposited within holes formed in the boron doped layer 22 prior to the trench etch. Such residue can block the ink feed holes after the TMAH etch.

Retaining the boron doped layer 22 (also referred to as a membrane) beneath the heater resistors 25 provides an excellent heat sink to remove heat from the resistor area.

A passivation layer may be deposited on the back surface of the substrate if reaction of the substrate with ink is a concern.

The above invention may utilize any ink channel pattern formed in the boron doped layer 22. FIGS. 8–12 illustrate various patterns of the ink channels that can be substituted for the pattern shown in FIG. 5B. The opening in the thin film layers 24 are shown in dashed outline.

Accordingly, certain advantages of the process described above include:

1. The redundant ink-feed channel structures make the printhead particle tolerant.
2. The openings in the boron doped layer 22 are defined by photolithography independent from the openings in the thin film layer 24 and thus can be made slightly larger than the openings in the thin film layers to improve fluid efficiency and relax the mask tolerances.
3. The thin film ink feed holes can be protected during the slot etch by the boron doped layer 22, which eliminates any undercutting of the thin film/silicon interface by the slot etch.
4. Since the boron doped layer 22 opening is defined by photolithography, the opening critical dimension can be controlled much more precisely than any front side etching process, which is affected by many factors such as boron doping, drive-in, various thermal cycles, as well as the TMAH process.

Figure 13:
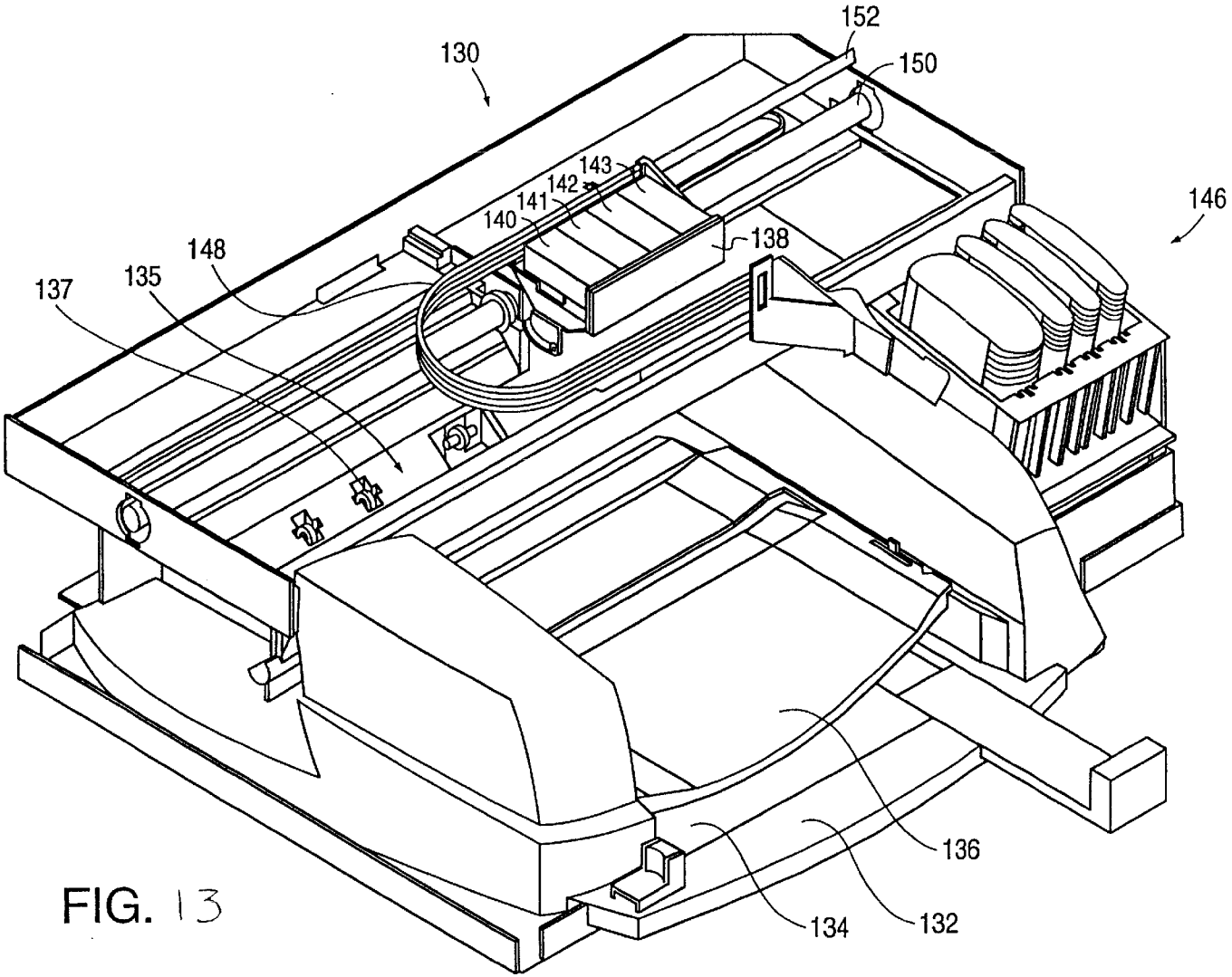
FIG. 13 is a perspective view of one embodiment of an inkjet printer that may incorporate the printhead of the present invention.

FIG. 13 illustrates one embodiment of an inkjet printer 130 that can incorporate the invention. Numerous other designs of inkjet printers may also be used along with this invention. More detail of an inkjet printer is found in U.S. Pat. No. 5,852,459, to Norman Pawlowski et al., incorporated herein by reference.

Inkjet printer 130 includes an input tray 132 containing sheets of paper 134 which are forwarded through a print zone 135, using rollers 137, for being printed upon. The paper 134 is then forwarded to an output tray 136. A moveable carriage 138 holds print cartridges 140–143, which respectively print cyan (C), black (K), magenta (M), and yellow (Y) ink.

In one embodiment, inks in replaceable ink cartridges 146 are supplied to their associated print cartridges via flexible ink tubes 148. The print cartridges may also be the type that hold a substantial supply of fluid and may be refillable or non-refillable. In another embodiment, the ink supplies are separate from the printhead portions and are removeably mounted on the printheads in the carriage 138.

The carriage 138 is moved along a scan axis by a conventional belt and pulley system and slides along a slide rod 150. In another embodiment, the carriage is stationery, and an array of stationary print cartridges print on a moving sheet of paper.

Printing signals from a conventional external computer (e.g., a PC) are processed by printer 130 to generate a bitmap of the dots to be printed. The bitmap is then converted into firing signals for the printheads. The position of the carriage 138 as it traverses back and forth along the scan axis while printing is determined from an optical encoder strip 152, detected by a photoelectric element on carriage 138, to cause the various ink ejection elements on each print cartridge to be selectively fired at the appropriate time during a carriage scan.

The printhead may use resistive, piezoelectric, or other types of ink ejection elements.

As the print cartridges in carriage 138 scan across a sheet of paper, the swaths printed by the print cartridges overlap. After one or more scans, the sheet of paper 134 is shifted in a direction towards the output tray 136, and the carriage 138 resumes scanning.

The present invention is equally applicable to alternative printing systems (not shown) that utilize alternative media and/or printhead moving mechanisms, such as those incorporating grit wheel, roll feed, or drum or vacuum belt technology to support and move the print media relative to the printhead assemblies. With a grit wheel design, a grit wheel and pinch roller move the media back and forth along one axis while a carriage carrying one or more printhead assemblies scans past the media along an orthogonal axis. With a drum printer design, the media is mounted to a rotating drum that is rotated along one axis while a carriage carrying one or more printhead assemblies scans past the media along an orthogonal axis. In either the drum or grit wheel designs, the scanning is typically not done in a back and forth manner as is the case for the system depicted in FIG. 13.

Multiple printheads may be formed on a single substrate. Further, an array of printheads may extend across the entire width of a page so that no scanning of the printheads is needed; only the paper is shifted perpendicular to the array.

Additional print cartridges in the carriage may include other colors or fixers.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A printing device comprising:

a printhead having a first thickness portion and a reduced thickness portion;

at least one ink ejection element formed overlying a first surface of said reduced thickness portion;

at least one ink feed hole formed through said reduced thickness portion providing an ink path from a second surface of said reduced thickness portion to a respective ink ejection element; and at least one ink channel formed in said reduced thickness portion leading to a respective ink feed hole, said at least one ink channel allowing ink to flow to said respective ink ejection element if a particle blocks an opening of said respective ink feed hole.

2. The device of claim 1 wherein said printhead has a trench formed in it, said reduced thickness portion forming a base of said trench.

3. The device of claim 1 wherein said at least one ink ejection element is formed from one of a plurality of thin film layers overlying said reduced thickness portion.

4. The device of claim 1 further comprising an orifice layer formed over said at least one ink ejection element, said orifice layer defining nozzles through which droplets of ink are ejected.

5. The device of claim 1 further comprising an ink chamber surrounding each ink ejection element, said at least one ink feed hole allowing ink to enter said ink chamber.

6. The device of claim 1 wherein said reduced thickness portion is a boron doped layer.

7. The device of claim 1 wherein said at least one ink channel comprises only one ink channel for each ink feed hole, each said ink feed hole having a width, said ink channel having a width narrower than said width of said ink feed hole.

8. The device of claim 1 wherein said at least one ink channel comprises a plurality of ink channels for each ink feed hole, each said ink feed hole having a width, said ink channels each having a width narrower than said width of said ink feed hole.

9. The device of claim 1 wherein said at least one ink channel comprises exactly two ink channels for each ink feed hole, each said ink feed hole having a width, said ink channels having a width narrower than said width of said ink feed hole.

10. The device of claim 1 wherein said at least one ink channel comprises exactly three ink channels for each ink feed hole, each said ink feed hole having a width, said ink channels each having a width narrower than said width of said ink feed hole.

11. The device of claim 1 further comprising an inkjet printer supporting said printhead.

12. The device of claim 1 further comprising a print cartridge housing said printhead for use in an inkjet printer.

13. The device of claim 1 further comprising an ink supply fluidically coupled to said at least one ink channel.

14. A method for forming a printing device comprising:

providing a printhead having a first thickness portion and a reduced thickness portion;

forming at least one ink ejection element overlying a first surface of said reduced thickness portion;

forming at least one ink feed hole through said reduced thickness portion providing an ink path from a second surface of said reduced thickness portion to a respective ink ejection element; and forming at least one ink channel in said reduced thickness portion leading to a respective ink feed hole, said at least one ink channel allowing ink to flow to said respective ink ejection element if a particle blocks an opening of said respective ink feed hole.

15. The method of claim 14 further comprising forming a trench in said printhead, said reduced thickness portion forming a base of said trench.

16. The method of claim 14 further comprising forming an orifice layer over said at least one ink ejection element, said orifice layer defining nozzles through which droplets of ink are ejected.

17. The method of claim 14 further comprising forming an ink chamber surrounding each ink ejection element, said at least one ink feed hole allowing ink to enter said ink chamber.

18. The method of claim 14 wherein said providing said printhead comprises doping a surface of a printhead substrate with boron for subsequently forming said reduced thickness portion.

19. The method of claim 14 wherein said forming at least one ink channel comprises forming a plurality of ink channels for each ink feed hole, each said ink feed hole having a width, said ink channels each having a width narrower than said width of said ink feed hole.

20. The method of claim 14 wherein said forming said at least one ink feed hole and said at least one ink channel is performed by etching from said second surface of said reduced thickness portion.

21. A method of printing comprising:

feeding ink to a trench formed in a printhead substrate, said substrate including a reduced thickness portion forming a base of said trench;

channeling said ink into at least one ink channel formed in said reduced thickness portion of said printhead substrate, said at least one ink channel terminating in a side of a respective one of a plurality of ink feed holes formed through said reduced thickness portion of said substrate;

flowing said ink through said ink feed holes and into respective ink chambers formed overlying said reduced thickness portion of said substrate; and energizing ink ejection elements within said respective ink chambers to expel ink through associated nozzles.

* * * * *